United States Patent [19]

James

[11] 4,028,749

[45] June 14, 1977

[54] SANITARY CHAIRS

[76] Inventor: David Richard James, Gloucester, England

[22] Filed: Jan. 13, 1976

[21] Appl. No.: 648,774

[30] Foreign Application Priority Data

Jan. 21, 1975 United Kingdom ..... 2539/75

[52] U.S. Cl. ..... 4/134; 297/134; 297/440; 297/443; 297/445

[51] Int. Cl.[2] ..... A47K 11/02; A47K 11/04; A61G 7/02

[58] Field of Search ..... 4/1, 134, 145; 297/348, 297/417, 440, 445, 443, 419, 217, 134, 130

[56] References Cited

UNITED STATES PATENTS

| | | | |
|---|---|---|---|
| 2,913,732 | 11/1959 | Jones | 4/134 |
| 3,215,469 | 11/1965 | Wamsley | 297/348 |
| 3,341,864 | 9/1967 | Wichmann | 4/134 |
| 3,787,903 | 1/1974 | Miller | 4/134 |
| 3,795,923 | 3/1974 | Thomas | 4/134 |
| 3,829,908 | 8/1974 | Thomas | 4/1 |
| 3,854,773 | 12/1974 | Thomas | 297/417 |

*Primary Examiner*—Henry K. Artis
*Attorney, Agent, or Firm*—Cushman, Darby & Cushman

[57] ABSTRACT

A sanitary chair has a frame comprising a seat frame portion and a base frame portion. The seat portion is supported on the base portion by telescopic support means, whereby to allow adjustment of the supported height of an apertured seat of the chair. The frame structure tapers to provide an opening at the rear larger than the front of the chair, whereby a plurality of similar chairs can be stacked in line nesting one within the other.

9 Claims, 3 Drawing Figures

SANITARY CHAIRS

FIELD OF THE INVENTION

This invention relates to sanitary chairs, i.e. to chairs with an apertured seat adapted to be positioned over a W.C. pedestal for toiletting purposes.

BACKGROUND OF THE INVENTION

Sanitary chairs are normally designed so as to be used universally with the very wide range of W.C. pedestal heights which are encountered. There is a considerable difference in height between some modern low suite pedestals and the high pedestals which one finds, for example, in the older hospitals and institutions where the chairs are commonly used. The normal construction does not readily lend itself to any form of height adjustment, and thus chairs are used which are inconveniently and unnecessarily high in many situations, or which cannot be used with many pedestals.

SUMMARY OF THE INVENTION

The object of the invention is to provide a new design of sanitary chair which enables the seat height to be adjusted.

According to one aspect of the invention a sanitary chair has a seat frame portion supported by telescopic support means on a base frame portion, whereby to allow telescopic adjustment of the supported height of the seat. Two telescopic supports are respectively positioned adjacent rear corners of the chair, so that the seat frame portion is supported generally in a cantilever fashion forwardly from the supports.

For height adjustment the chassis portion may have upwardly projecting stubs which support and telescopically engage with said two rear support legs. Preset height adjustment may be retained by cross pins through registering holes in the stubs and legs, the stubs and/or legs having a range of such holes appropriately spaced for stepwise height adjustment. Generally speaking, heightwise adjustment over a range of 4 to 5 inches is desirable with a minimum ground clearance beneath the seat of about 17 inches.

A hinged footrest may be provided, which hinges upwardly to behind the front of the seat to facilitate entry and exit to and from the chair. This footrest may be hinged on a cross member towards the front of the chassis frame, and in the operative down position the footrest may rest on the mountings of two front castors of the chair.

According to another aspect of the invention, a sanitary or commode chair has a tubular frame structure which, particularly as regards a base frame portion of the structure, tapers to provide an opening at one end larger than the other end, whereby a plurality of similar chairs can be stacked in line nesting one within another.

Preferably the base frame portion tapers continuously from back to front, i.e. is of generally trapezium shape in plan view, being of increased width at the rear. Thus a rear opening is provided which is larger than the front of the chair so that one chair can nest within the rear of another.

Other features of the invention will be apparent from the following description, drawings and claims, the scope of the invention not being limited to the drawings themselves as the drawings, are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
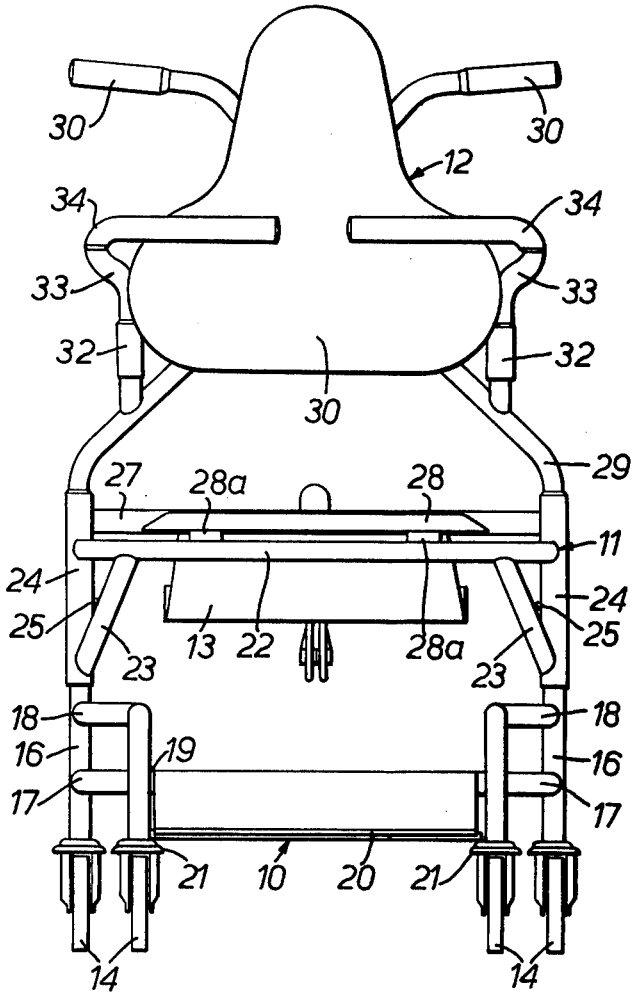
FIG. 1 is a front view of a sanitary chair in accordance with the invention.

The chair has a tubular frame construction, and comprises a mobile chassis base frame portion 10 and a seat portion 11 integral with a backrest portion 12. The drawings show a toilet pan which clips on below the seat portion 11 for use as a commode chair, the pan 13 not being fitted when the chair is used for its more usual toilet function in conjunction with a W.C.

The chassis frame portion 10 is open at the rear so that the chair can be wheeled backwards over a W.C. pan, and it has four corner castors 14. The front castors have brakes 15 which can be applied to immobilise the chair when in position. Vertical rear corner members 16 have the rear castors 14 fitted to them, and the portion 10 further comprises spaced parallel side members 17 and 18 at each side interconnected by a cross member 19 towards the front of the chassis. The upper side members 18 are bent downwardly at the front to provide vertical end portions to which the front castors 14 are fitted.

Figure 3:
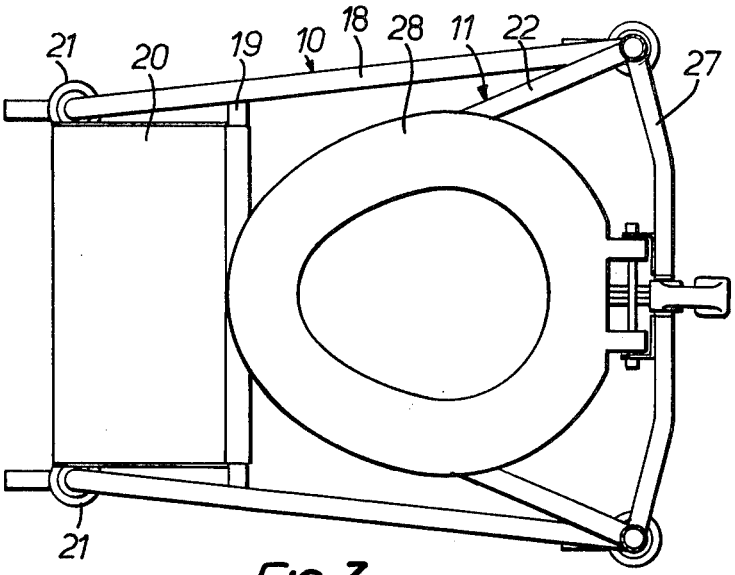
FIG. 3 is a plan view on the line III - III in FIG. 2.
Figure 2:
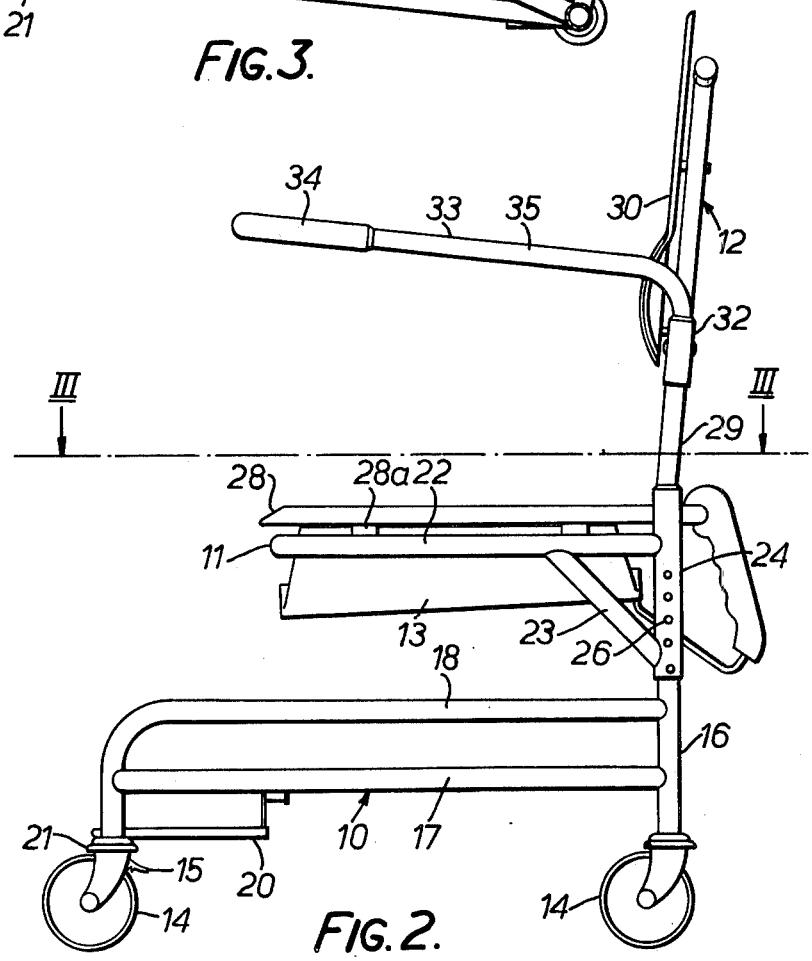
FIG. 2 is a side view thereof.

As can be seen from FIGS. 1 and 3 the side members 17 and 18 at the two sides of the chassis are mutually inclined, to provide in plan view a generally trapezium shape narrower at the front. Thus the chair fits into the rear of a similar chair, and hence a plurality of chairs can be stacked in a small space in nesting relationship, one fitting into the rear of another.

A footrest 20 of the chassis portion 10 is hinged on the front cross member 19 and, in the operative down position shown, rests on the mountings 21 of the front castors 14.

The seat portion 11 comprises a seat support frame member 22 which is generally V-shaped and disposed in a horizontal plane. It has short rear support struts 23 but is mainly cantilevered from corner rear support legs 24. These legs 24 telescopically engage the chassis corner members 16 to provide telescopic supports for the purpose of heightwise adjustment of the seat portion 10. The adjustment is set, once made to suit the height of a particular W.C. pedestal, by means of pins 25 inserted through registering holes in the legs 24 and chassis members 16, the latter forming stubs engaging within the legs 14. Alternatively the legs 24 may engage within the members 16.

A cross member 27 interconnects the support legs 24 and to this a moulded toilet seat 28 is rearwardly hinged. The seat 28 is similar to a normal W.C. toilet seat and has lower support pads **28*a* by which it rests on the frame member 22, when in the down position. The cross member 27 is above the frame member 22 so that it does not impede nesting of two chairs, before which the seat 28** of the rear chair is hinged up out of the way.

The back portion 13 comprises two side frame members 29 which extend upwardly from the legs 24 and are mutually inclined inwardly to provide back support for a moulded backrest 30. At a suitable level the members 29 are out-turned to provide hand grips 31 by which the chair can be propelled. Welded to each of the side members 29 is a pivotal mounting 32 for an armrest 33.

Each armrest 33 can pivot as a whole, to one side and about a generally vertical but slightly rearwardly inclined axis in the corresponding mounting 32, out of the way to enable an elderly user to be slid on the seat 28 from that side. Inturned end portions 34 of the armrests provide front support for the user, which is especially valuable with the elderly and infirm. The armrests 33 are self-locking in position, having to be lifted slightly before they can be turned to the side in the mountings 32.

When side access is not required, the end portions 34 can be turned upwardly and outwardly on their own on the main side members 35 of the armrests 33. Thus they can be turned out of the way, about more or less horizontal axes aligned with the side members 35, to allow front access to the chair between the armrests 33. The end portions 34 turn freely through about 180° between the laterally inturned front support position shown and the laterally out-turned front entry positions. In the latter position they can provide a hand grip and support to assist a disabled user when entering or leaving the chair.

As a modification, the seat 28 may be hinged about a rear axis set up above the seat level, thus providing a construction such that as two chairs are nested one within the other the seat of the rear chair automatically lifts the seat of the front chair so as to slide beneath it. Alternatively, the seat 28 may be permanently fixed to the support frame 22, which may then be recessed into the bottom of the seat 28, the frame 22 then being hinged to the support leg structure. Further the toilet aperture in the seat 28 may be extended rearwardly through to the back of the seat which is thus cut away centrally at the rear. This provides a hygenic arrangement which materially cuts down soiling of the seat.

As a further modification, it is envisaged that the seat 28 and the backrest 30 may be formed as a one-piece plastics moulding.

Due to the facility for height adjustment, the chair is very suitable for use with an automatic W.C. of the type generally known by the trade mark "Clos-o-Mat", and which incorporates automatic washing and hot-air drying arrangements. These do not operate satisfactorily with an excessive clearance between the W.C. pedestal and the seat, with the result that they cannot be used with many prior sanitary chairs not of the appropriate height.

I claim:

1. A mobile sanitary chair having a tubular metal frame comprising a base frame portion and a seat frame portion, said base frame portion having two upstanding seat support members respectively disposed adjacent rear corners of the chair, ground-support wheels mounted below the base frame portion, an apertured toilet seat supported by said seat frame portion, said seat frame portion having two support members respectively engaging said seat support members of the base frame portion to provide two telescopic supports which allow height adjustment of the seat with the seat frame portion supported by the base frame portion in a forwardly cantilevered manner, and separate locking means respectively associated with the two telescopic supports to retain a preset height adjustment, the frame being open at the rear below the seat and the frame tapering in plan view from front to rear whereby to enable a plurality of similar chairs to be stacked in line nesting one within the other.

2. A sanitary chair according to claim 1, wherein said support members of the seat frame portion comprise upwardly projecting stubs, and said support members of the seat frame portion comprise tubular support legs fitting over the upwardly projecting stubs.

3. A sanitary chair according to claim 1, wherein each of said separate locking means comprises a cross pin which engages through registering holes in the support members of the corresponding telescopic support.

4. A sanitary chair according to claim 1, wherein a hinged footrest is provided which hinges upwardly to behind the front of the seat to facilitate entry to and exit from the chair.

5. A sanitary chair according to claim 4, wherein the footrest is hinged on a cross member of the base frame portion towards the front of the chair, and in the operative down position rests on the mountings of two front castors of the chair.

6. A chair according to claim 1, wherein the seat frame portion comprises a frame member on which the apertured seat is directly supported and which is disposed so that it engages a W.C. pan to locate the seat accurately above the pan.

7. A chair according to claim 6, wherein said frame member is generally V shaped with a rounded and forwardly facing apex.

8. A chair according to claim 1, wherein said apertured seat is hinged about a rear axis set up above the seat level, so that as two chairs are nested one within the other the seat of the rear chair automatically lifts the seat of the front chair to slide beneath it.

9. A chair according to claim 1, having support means for supporting a toilet pan for use as a commode chair, the toilet pan being detachable for use of the chair with a W.C.

* * * * *